US008100578B2

(12) United States Patent
Ramhorst

(10) Patent No.: US 8,100,578 B2
(45) Date of Patent: Jan. 24, 2012

(54) HELICAL RIBBON MIXING GEAR

(76) Inventor: Bernd Ramhorst, Bielefeld (DE)

( * ) Notice: Subject to any disclaimer, the term of this patent is extended or adjusted under 35 U.S.C. 154(b) by 967 days.

(21) Appl. No.: 12/060,571

(22) Filed: Apr. 1, 2008

(65) Prior Publication Data

US 2009/0161483 A1 Jun. 25, 2009

(30) Foreign Application Priority Data

Dec. 21, 2007 (DE) ..... 10 2007 063 071

(51) Int. Cl.
*B01F 7/24* (2006.01)

(52) U.S. Cl. ..... 366/320

(58) Field of Classification Search ..... 366/320, 366/323, 324, 325.3, 325.6, 325.8, 342, 343, 366/325.7, 328.1

See application file for complete search history.

(56) References Cited

U.S. PATENT DOCUMENTS

| | | | | | |
|---|---|---|---|---|---|
| 28,760 | A * | 6/1860 | Mclean et al. | 366/342 |
| 61,494 | A * | 1/1867 | Westover | 366/328.1 |
| 125,255 | A * | 4/1872 | Bankard | 366/343 |
| 301,506 | A * | 7/1884 | Massey | 198/676 |
| 2,851,257 | A * | 9/1958 | Morgan | 366/195 |
| 3,130,070 | A * | 4/1964 | Potters et al. | 427/214 |
| 3,393,899 | A * | 7/1968 | Wells | 366/141 |
| 3,595,627 | A * | 7/1971 | Abbot et al. | 422/137 |
| 3,730,486 | A * | 5/1973 | Hayashi et al. | 366/149 |
| 4,004,786 | A * | 1/1977 | Stephens | 366/330.7 |
| 4,187,030 | A * | 2/1980 | Godley | 366/319 |
| 4,274,751 | A * | 6/1981 | Rector et al. | 366/310 |
| 4,344,580 | A * | 8/1982 | Hoshall et al. | 241/60 |
| 4,826,089 | A * | 5/1989 | Psaltopoulos | 241/45 |
| 4,978,078 | A * | 12/1990 | Vadnay | 241/74 |
| 5,188,808 | A * | 2/1993 | Lilja et al. | 422/229 |
| 5,443,588 | A * | 8/1995 | Loppoli | 414/526 |
| 5,615,951 | A * | 4/1997 | Gabriele | 366/311 |
| 5,984,218 | A * | 11/1999 | Peat | 241/260.1 |
| 6,092,750 | A * | 7/2000 | Kooima et al. | 241/101.76 |
| 6,250,797 | B1 * | 6/2001 | Weetman | 366/270 |
| 6,273,350 | B1 * | 8/2001 | Kirby et al. | 241/260.1 |
| 6,349,570 | B1 * | 2/2002 | Coates et al. | 65/135.9 |
| 6,612,733 | B2 * | 9/2003 | Schmidt et al. | 366/310 |
| 7,131,765 | B2 * | 11/2006 | Backhaus | 366/149 |
| 7,871,024 | B2 * | 1/2011 | Peeters et al. | 239/667 |
| 2004/0136263 | A1 * | 7/2004 | Backhaus | 366/291 |

FOREIGN PATENT DOCUMENTS

| | | | |
|---|---|---|---|
| CH | 672267 | * | 11/1989 |
| DE | 10359379 A1 | * | 7/2004 |
| DE | 102007063071 B3 | * | 2/2009 |

* cited by examiner

*Primary Examiner* — Tony G Soohoo

(74) *Attorney, Agent, or Firm* — Browdy and Neimark, PLLC

(57) ABSTRACT

The invention relates to a helical ribbon mixing gear with a mixing vessel (1), the inside of which is axially symmetrical, and a motor-driven central agitator axis (2) with laterally extending agitator anus (30, 31, 32) to which at least one sloping helical ribbon (4) with a circular inclination in a direction of rotation (D) is attached, an outer edge of the helical ribbon (40) being positioned near to a mixing vessel wall (10), an outer tooth profile (50-52) being formed at the wall-sided edge of the helical ribbon (40), with a radial profile depth (T) which is smaller than a radially adjacent ribbon width (B), and with a circular tooth spacing (W) of one to ten times the profile depth (T).

17 Claims, 7 Drawing Sheets

HELICAL RIBBON MIXING GEAR

The invention relates to a helical ribbon mixing gear with a mixing vessel, the inside of which is axially symmetrical, and a motor-driven central agitator axis with laterally extending agitator arms to which at least one sloping helical ribbon with a circular inclination in a direction of rotation is attached, an outer edge of the helical ribbon being positioned near to a mixing vessel wall.

Such a helical ribbon mixing gear is known from DE 103 59 379 A1. Here, the helical ribbon has a continuous small distance to the mixing vessel wall, which creates a friction of the introduced material to be mixed against the wall, causing an uplift of the material to be mixed. But, if the distance is very small, the material to be mixed and of the vessel wall, are subject to an unduly strain. In addition, the emptying of granular material to be mixed is obstructed, even if a combined circular and radial inclination of the mixing ribbon is provided, which is larger than the sliding angle of the material to be mixed.

To provide a remedy the mixing vessel wall in DE 1557009 A1 has a shape that diverges towards the top, and the agitator axis is connected with the helical ribbon with a height adjustment drive, so that the distance towards the wall can be adjusted according to the nature of the material to be mixed. This execution is costly and necessitates a positioning operation for each new employment.

It is the object of the invention to reveal a simple embodiment, effective without service, which protects the material to be mixed whilst providing an improved mixing performance and better emptying.

This object is solved in such a way that an outer tooth profile is formed at the wall-sided edge of the helical ribbon, with a radial profile depth which is smaller than a radially adjacent ribbon width, and with a circular tooth spacing of one to ten times the profile depth.

Advantageous embodiments are indicated in the subclaims.

The outer tooth profile can be undulated or angular. A sinusoidal profile is preferred, which can be approximated by subsequently adjoining alternating circular arcs. An alternative angular profile, for example, presents rectangular, trapezoidal or half-wave teeth.

Additional profiling of the inner helical ribbon edge with an inner tooth profile further improves the mixing performance. Said profile can also have one of the mentioned profile types; preferably it is similar to the outer tooth profile and arranged in the same angular position.

A tooth spacing with one tooth at every 15° of circumference angle proves to be advantageous.

The gaps between the teeth provide a very short way towards the bottom outlet for the mixed material, when the mixing gear is emptied. In addition, strain is taken off the material to be mixed in the wall area during mixing, yet the wall-sided tooth ends provide a sufficient lifting friction, so that the desired upward draught forms above the helix. Thus, during operation, periodic lifting variations form in the circular areas above the tooth profile, which generate a mixing function advantageously moderating the main flow. An inner toothing of the helical ribbon edge provides a similar supplemental mixing function, by raising the inner shear zone, with varying strength, while the helical ribbon is rotated within the material to be mixed. In axial orientation, according to the altitude of the profile teeth, the material to be mixed forms circular areas which are conveyed in an alternately increasing and decreasing manner.

If the toothing on both sides are conformal, these shear variations occur on alternating sides of the helical ribbon, so that a kind of oscillation of the material to be mixed occurs in the upward conveying area.

The improved mixing function and the protection of the material to be mixed also occur when the helical ribbon is inclined inwards or towards the wall; the improved emptying is particularly important if the helical ribbon is inclined towards the wall.

Totalling, it is beneficial for the mixture if the inclination of the helical ribbon is greater than a friction angle. This is the angle, at which the mixture slides down from the helical ribbon.

Apart from the typical cylindrical form, the mixing vessel can also have different shapes.

For instance, the described types of the helical ribbon can also be used in a double-shaft mixing compartment. Also, the mentioned helical ribbons can be used in a bottom conical mixing compartment. Likewise they can be used for a mixing compartment with a dished end, which has an arched lower wall.

For conical mixing compartments the basic shape of the helix of the helical ribbon can advantageously be cut spirally out of a plate, the adjacent tooth profiles interlocking before the helix is extracted axially.

Advantageous embodiments are represented in the FIGS. 1 to 10.

Figure 1:
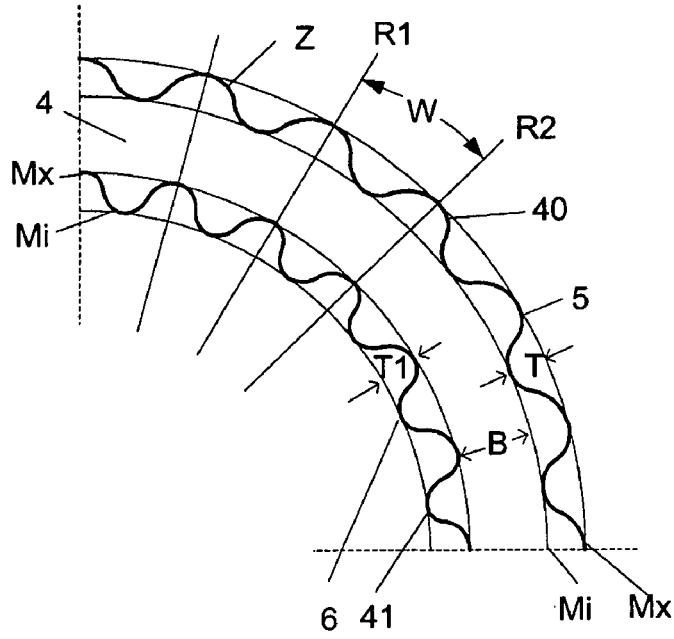
FIG. 1 shows a developed view of a section of a helical ribbon.

FIG. 1 shows a preferred embodiment of a helical ribbon 4 in developed, flat form. At its outer edge 40 nearly sinusoidal profile teeth Z form an outer tooth profile 5. Also an inner tooth profile 6 is formed at the inner helical ribbon edge 41. Its waveform is produced by alternating circular arcs, which are smoothly joined. The radial maxima Mx and minima Mi of the tooth profiles 56 are arranged on the same radial ray R1, R2 respectively, so that the helical ribbon has an overall wave shape. The width of the helical ribbon B is bigger than, and preferably twice as big as, the profile depths T, T1 of the outer or respectively the inner tooth profile 5, 6. The wavelength or tooth spacing W corresponds to approximately 2 to 3 times the profile depth T, T1. In this example the 1:5 angle between adjacent radii R1, R2 is about 15°. An angle from 10° to 20° has proven advantageous.

Figure 2:
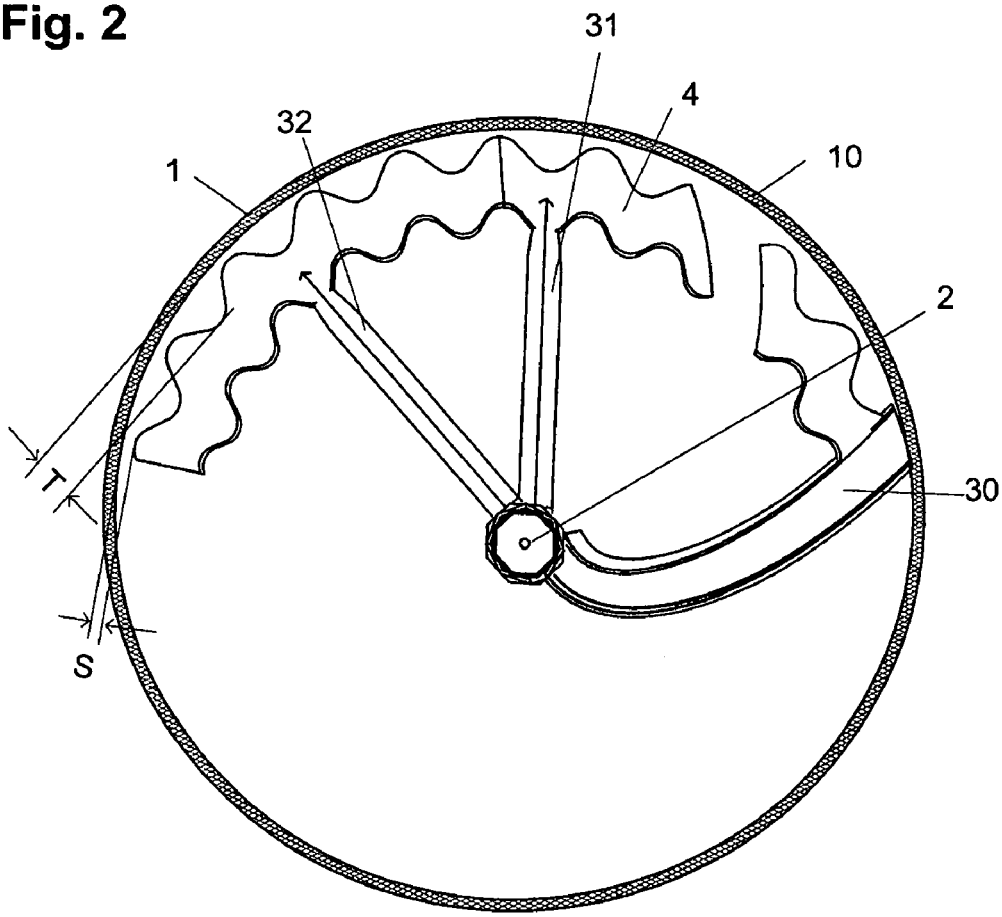
FIG. 2 shows a top view of a mixing tool.

FIG. 2 shows a horizontal projection of a semicircular helical ribbon 4 which is maintained centrally inside a mixing vessel, inside the vessel wall 10, by radial agitator arms 30-32 which are attached to an agitator axis 2. The gap S between the maxima Mx of the outer tooth profiles 5 is relatively small in relation to the profile depth T. Since this narrow gap S is so short, there is only little wear on the vessel wall 10, in the area of the Maxima on the helical ribbon, and on the material to be mixed.

Figure 3:
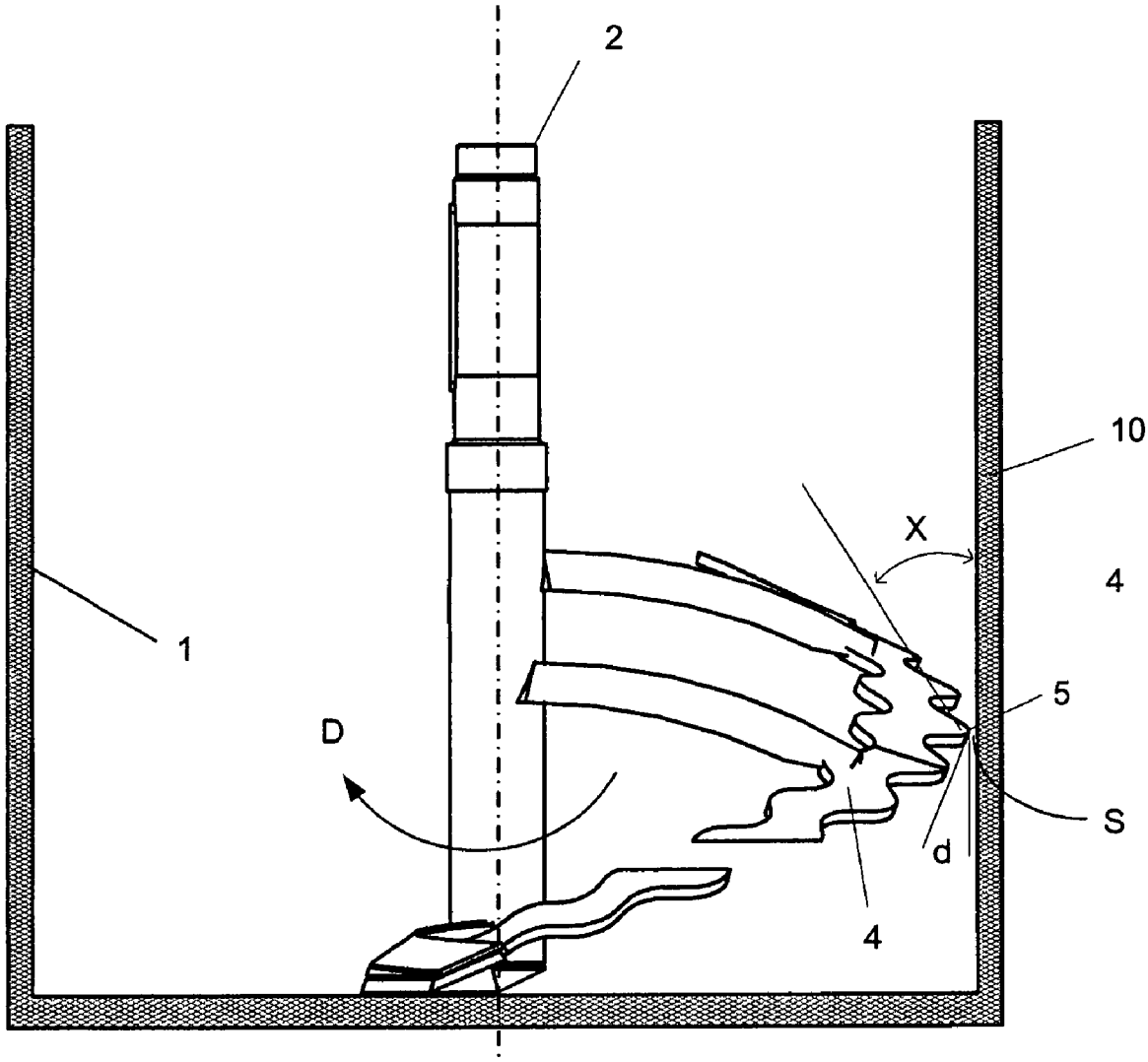
FIG. 3 shows a first side view of FIG. 2.

FIG. 3 shows a front view of the mixing gear without a drive to be connected at the top, with a laterally placed semicircle helical ribbon 4. The latter is inclined towards the mix vessel wall 10—schematically represented—, as indicated by the angle of inclination $\alpha$. The face of the outer tooth profile 5 is tapered downward and inclined towards the axis 2, as indicated by the angle of diminution $\delta$. The narrow gap S towards the wall thus exists only at certain points, that is in each of the maxima Mx of the profile 5. The direction of rotation D is shown on the agitator axis.

Figure 4:
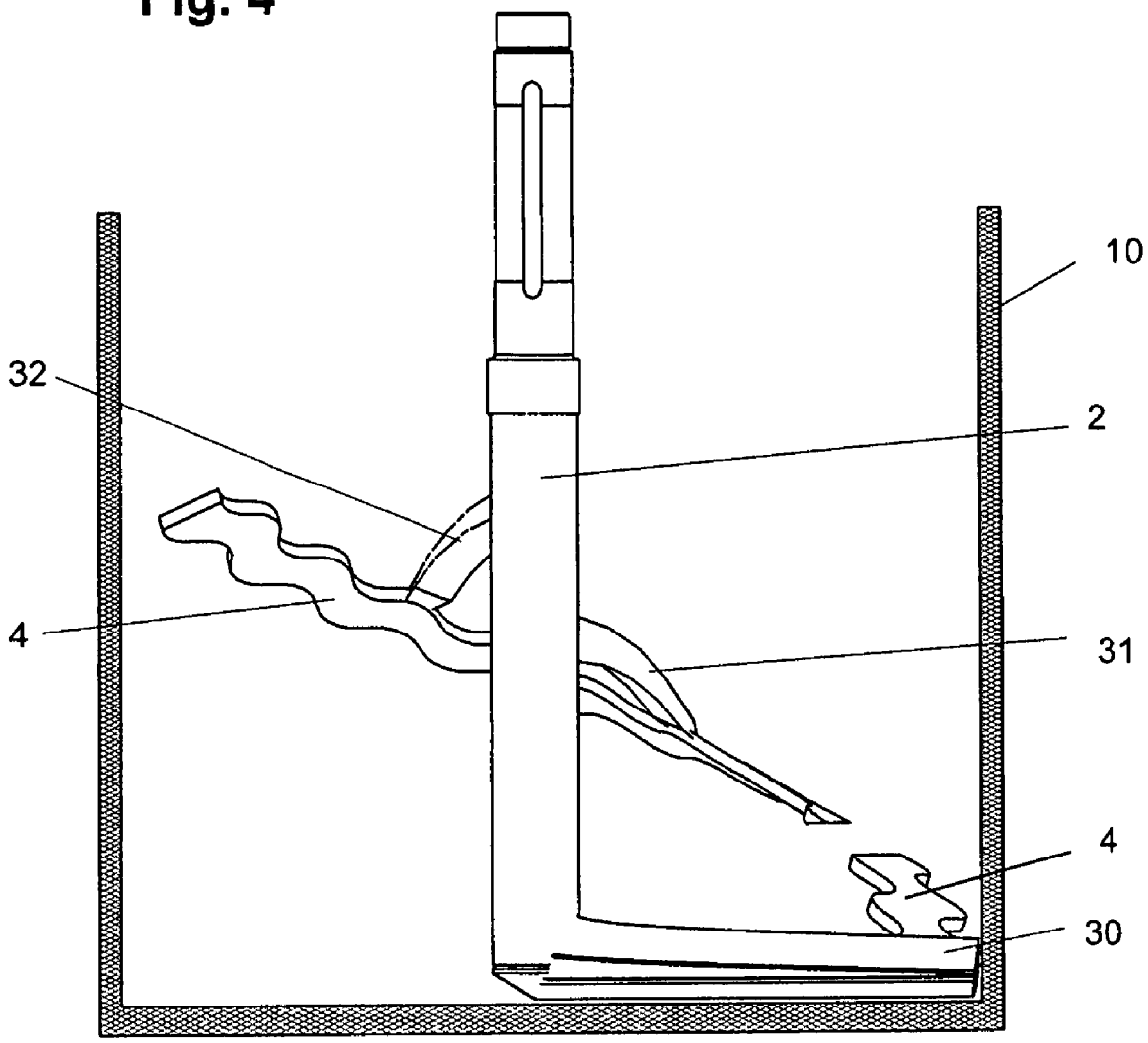
FIG. 4 shows a second side view of FIG. 2.

FIG. 4 shows a rear view of the mixing gear. One recognizes the agitator arms 30-32, which are fixed at different altitudes to the agitator axis 2 and the helical ribbon 4. A clearing arm, formed in a well-known manner, is provided at the bottom side of the mixing vessel.

Figure 5:
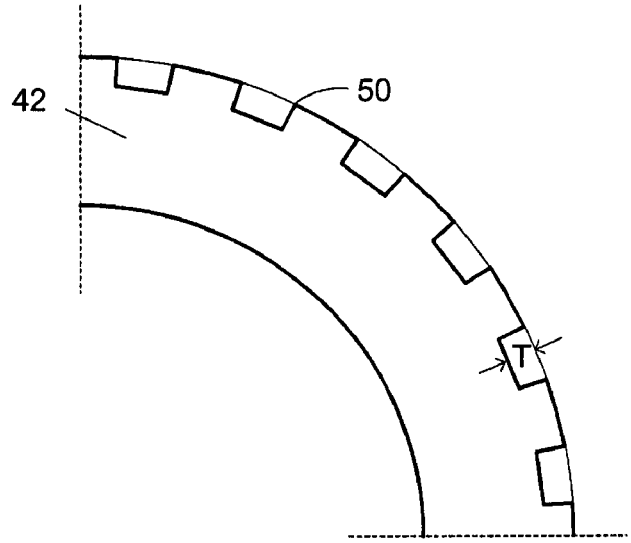
FIGS. 5-7 show further embodiments of sections of the helical ribbon.

FIG. 5 shows a section of an alternative helical ribbon 42 with a rectangular outer tooth profile 50.

Figure 6:
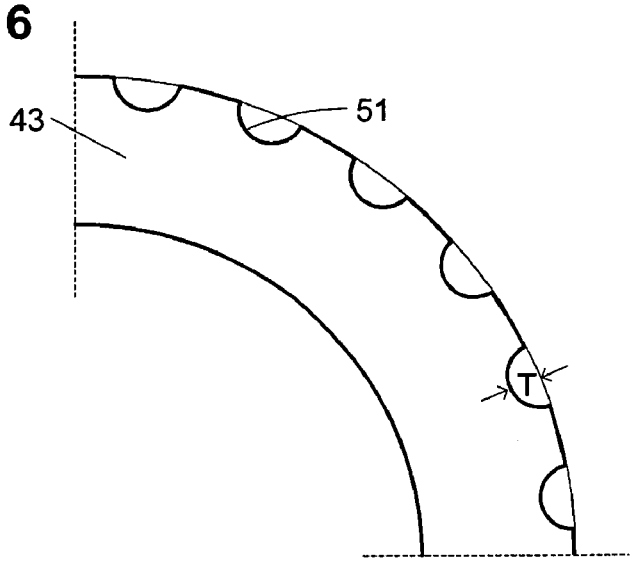

FIG. 6 shows a section with an arched outer tooth profile 51 of a further variant of the helical ribbon 43.

Figure 7:
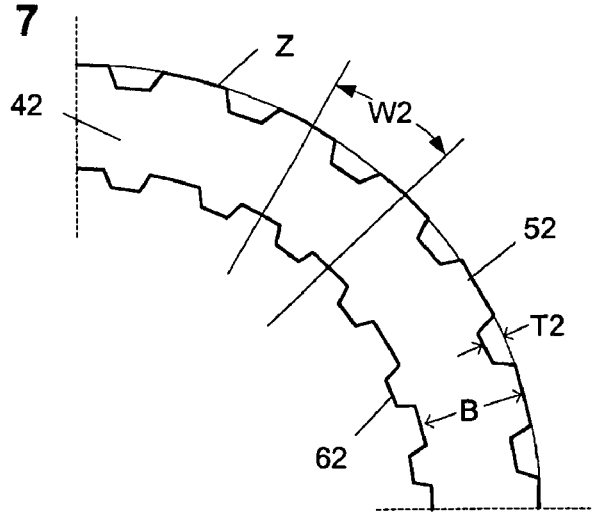

FIG. 7 shows a further variant of the helical ribbon 42 with a trapezoidal outer tooth profile 52 and a similar inner tooth profile 62. The profile depths T2 in this case amount approximately to a quarter of the helical ribbon width B. The ratio of the tooth spacing W2 to the profile depth is about 10 to 1. The tooth width is about half the width of the tooth gap.

Figure 8:
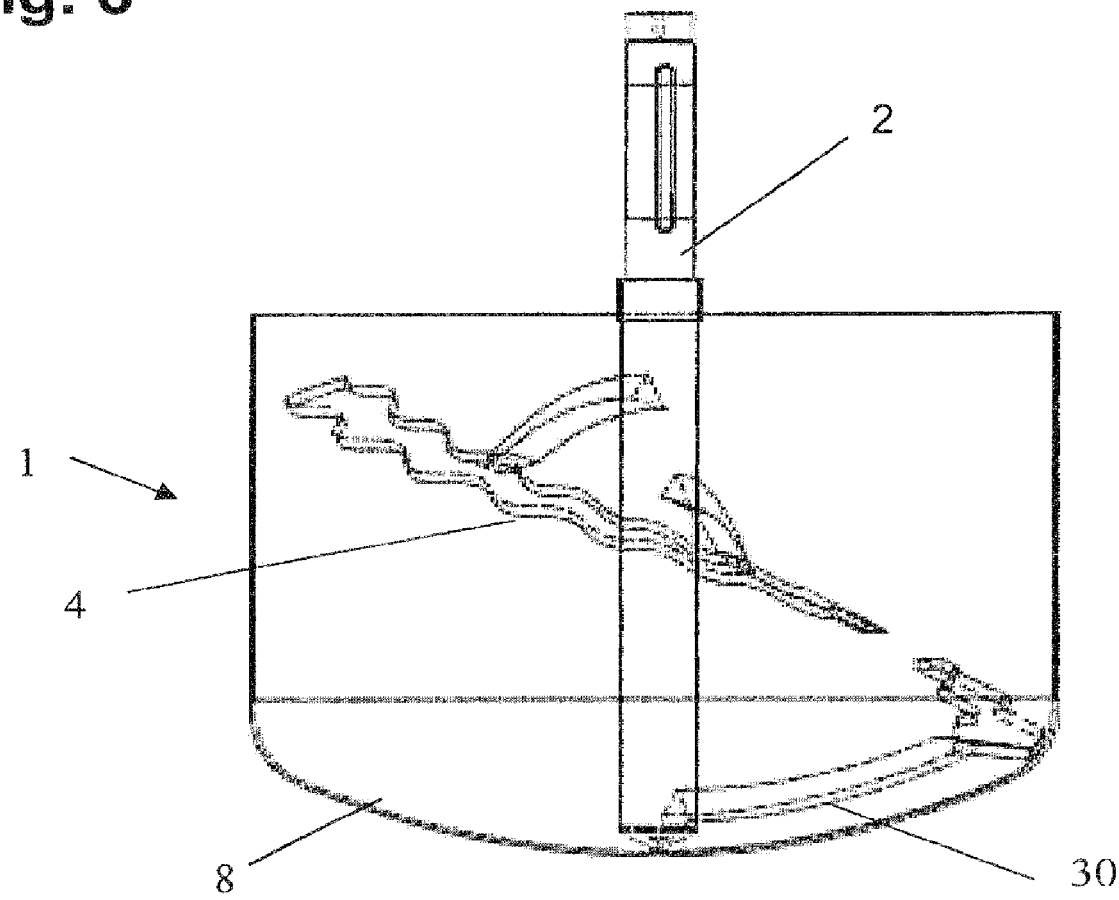
FIGS. 8-10 show embodiments of mixing vessels.

In FIG. 8 a mixing vessel 1 with a dished end 9 is presented in a cross sectional view. The agitator arm 30 is adjusted to the curvature of the bottom. The helical ribbon 4 revolves around the agitator axis 2 and extends to the curved dished end 9.

Figure 9:
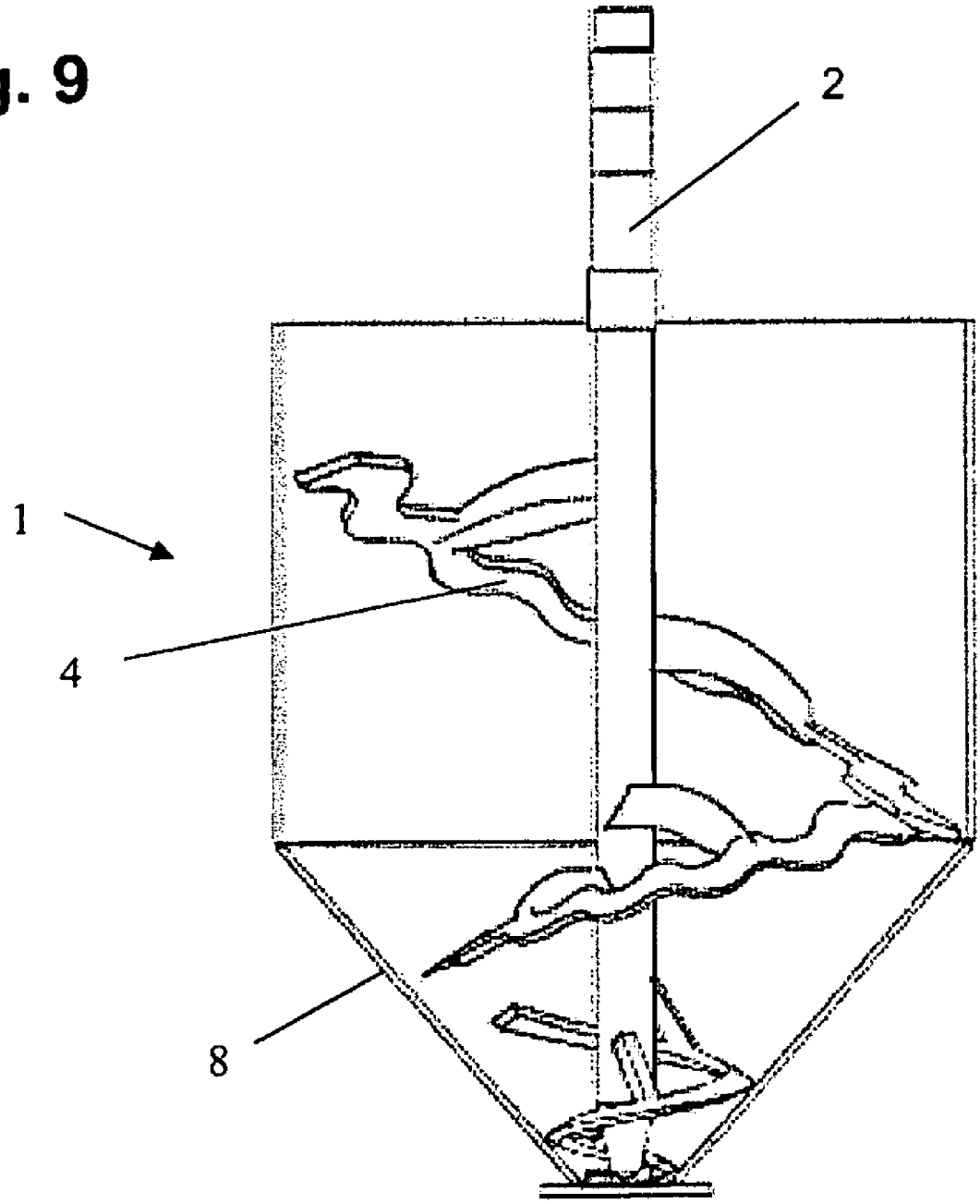

In FIG. 9 a mixing vessel 1 with a conical mixing compartment 8 is presented in a cross sectional view. The helical ribbon 4 revolves around the agitator axis 2 and becomes smaller towards the bottom of the mixing vessel.

Figure 10:
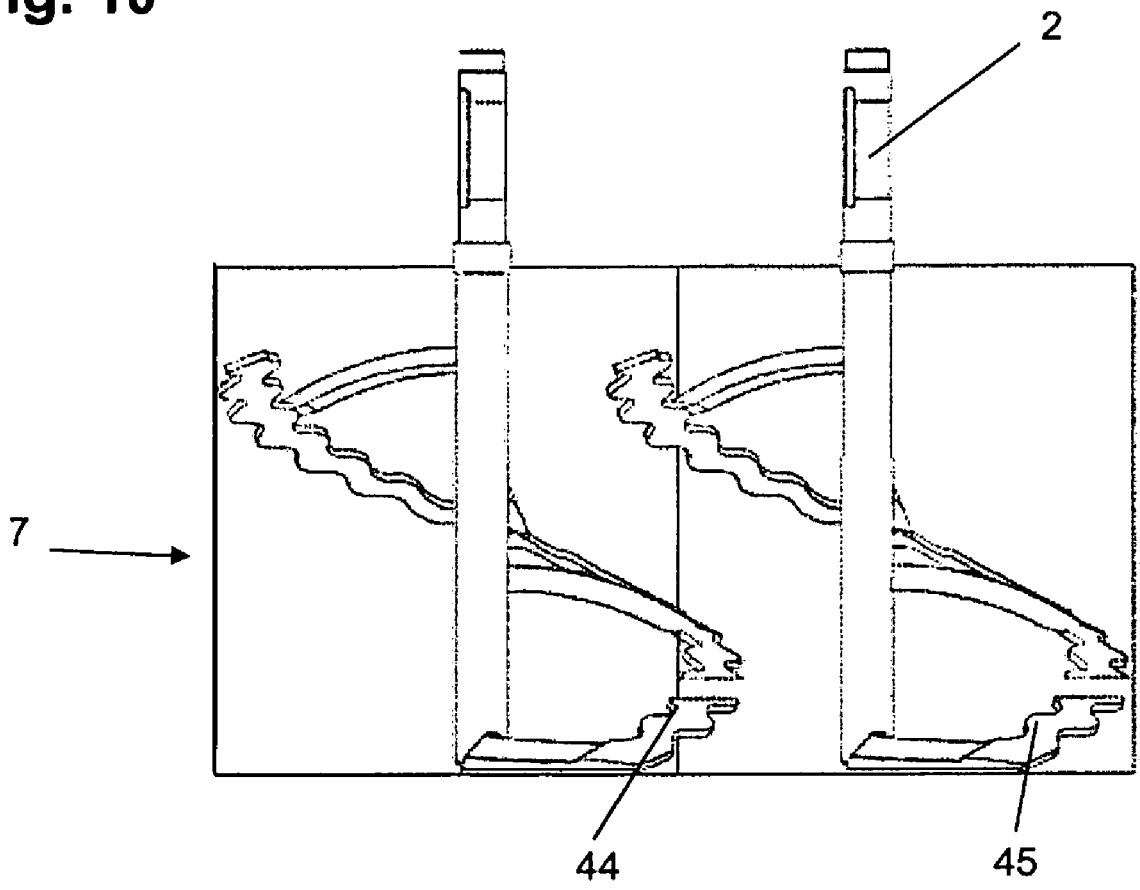

In FIG. 10 a double-shaft mixing compartment 7 is presented in a cross sectional view. The two helical ribbons 44 and 45 each revolve around an agitator axis 2.

REFERENCES

1 mixing vessel
10 mixing vessel wall
2 agitator axis
30-32 agitator arms
4 helical ribbon
40 outer edge of the helical ribbon
41 inner edge of the helical ribbon edge
42-43 alternative helical ribbons
5 outer tooth profile
50-52 alternative outer tooth profiles
6 inner tooth profile
7 two-shaft mixing compartment
8 conical mixing compartment
9 dished end
B width of the helical ribbon
D direction of rotation
Mi minimum
Mx maximum
R1, R2 radial rays
S gap
T profile depth of the outer tooth profile
T1 profile depth of the inner tooth profile
T2 profile depth of 52
W tooth spacing
W2 tooth spacing of 52
Z profile teeth
α angle of inclination of 4
δ angle of diminution of 40

The invention claimed is:

1. Helical ribbon mixing gear with a mixing vessel (1), the inside of which is axially symmetrical, and a motor-driven central agitator axis (2) with laterally extending agitator arms (30, 31, 32) to which at least one sloping helical ribbon (4) with a circular inclination in a direction of rotation (D) is attached, an outside edge of the helical ribbon (5) being positioned near to a mixing vessel wall (10), characterized in that an outer tooth profile (50-52) is formed at the wall-sided edge of the helical ribbon (40), with a radial profile depth (T), which is lower than a radially adjacent ribbon width (B), and with a circular tooth spacing (W) of one to ten times of the profile depth (T).

2. Helical ribbon mixing gear according to claim 1, characterized in that an inner edge of the helical ribbon (41) also has an inner tooth profile (6, 62).

3. Helical ribbon mixing gear according to claim 2, characterized in that the inner tooth profile (5,6) has a profile depth (T, T1, T2), which is smaller than a respectively radially adjacent helical ribbon width (B).

4. Helical ribbon mixing gear according to claim 3, characterized in that the inner tooth profile (5,6) has a tooth spacing (W, W2), which is one to ten times the profile depth (T, T1, T2).

5. Helical ribbon mixing gear according to claim 3, characterized in that the inner and/or outer tooth profile (5, 6) have a circular tooth spacing of 10°-20°.

6. Helical ribbon mixing gear according to claim 2, characterized in that the respective inner and the outer tooth profile (5, 6, 52, 62) are similar, so that the resulting intermediate helical ribbon width (B) is approximately constant in each case.

7. Helical ribbon mixing gear according to claim 2, characterized in that the inner and/or the outer tooth profile (5, 6, 50-52, 62) are undulated or angular.

8. Helical ribbon mixing gear according to claim 7, characterized in that the inner and/or the outer tooth profile (5, 6) are nearly sinusoidal.

9. Helical ribbon mixing gear according to claim 8, characterized in that the sinusoidal shape is formed by alternating circular arcs with smooth junctions.

10. Helical ribbon mixing gear according to claim 7, characterized in that the inner and the outer tooth profile (50-52, 62) have a rectangular, trapezoidal or circarc shape.

11. Helical ribbon mixing gear according to claim 1, characterized in that the helical ribbon (4) is inclined by an angle (α) towards the mixing vessel wall (10).

12. Helical ribbon mixing gear according to claim 1, characterized in that the face of the outer tooth profile (5) is tapered downward at an angle of diminution (δ).

13. Helical ribbon mixing gear according to claim 1, characterized in that the outer tooth profile (5) is held in such a way that a gap (S), substantially narrower than the ribbon width (B), is spared towards the mixing vessel wall (10).

14. Helical ribbon mixing gear according to claim 1, characterized in that the helical ribbon (4) is inclined at an angle greater than a friction angle.

15. Helical ribbon mixing gear according to claim 1, characterized in that the mixing vessel (1) is formed as a double-shaft mixing vessel (7).

16. Helical ribbon mixing gear according to claim 1, characterized in that the mixing vessel (1) has a mixing compartment (8) which is conical towards the bottom.

17. Helical ribbon mixing gear according to claim 1, characterized in that the mixing vessel (1) has a dished end (9).

* * * * *